United States Patent [19]

Kazanjian

[11] Patent Number: 4,507,884

[45] Date of Patent: Apr. 2, 1985

[54] PICTURE DISPLAY ASSEMBLY

[76] Inventor: Harout Kazanjian, 11456 W. Washington Blvd., Los Angeles, Calif. 90066

[21] Appl. No.: 576,933

[22] Filed: Feb. 6, 1984

[51] Int. Cl.[3] ..... G09F 13/00

[52] U.S. Cl. ..... 40/152.2

[58] Field of Search ..... 40/152, 152.1, 617, 40/10 R; 248/466, 489

[56] References Cited

U.S. PATENT DOCUMENTS

| | | | |
|---|---|---|---|
| 2,492,411 | 12/1949 | Barnes et al. | 40/152.1 X |
| 2,709,056 | 5/1955 | Jaquet | 40/152.1 |
| 2,791,051 | 5/1957 | Scheyer | 40/152.1 |
| 2,810,226 | 10/1957 | Horwitt | 40/152.1 |
| 3,783,544 | 1/1974 | Brody | 40/152.2 |
| 3,862,505 | 1/1975 | Jeroma | 40/564 |

*Primary Examiner*—Gene Mancene
*Assistant Examiner*—Wenceslao J. Contreras
*Attorney, Agent, or Firm*—William W. Haefliger

[57] ABSTRACT

A picture display assembly comprises:

(a) a rectangular, upright base frame having front and back sides, (b) structure on the base from which it is connectible to a wall, (c) first horizontal ledge structure on the base frame and exposed at the front side thereof, the first ledge structure having at least one upwardly projecting, horizontally elongated tongue, (d) an upright picture display plate having front and back sides, and a transparent medial section adapted to register with said base frame, (e) structure on the plate for supporting at least one translucent picture sheet to hang at the front side of said medial section of the plate, (f) and second horizontal ledge structure on and exposed at the rear side of the plate, the second ledge structure having at least one downwardly projecting, horizontally elongated tongue sized to removably and downwardly seat over the first ledge structure tongue and removably supporting the plate on the base frame and at the front side thereof.

9 Claims, 8 Drawing Figures

PICTURE DISPLAY ASSEMBLY

BACKGROUND OF THE INVENTION

This invention relates generally to display of pictures, and more specifically to apparatus enabling selective display of pictures on wall frames and apart from the latter, in a ready and accessible manner.

The invention solves the problem of how to readily and accessibly selectively display a picture such as an overlay of translucent sheets on a wall frame as for illumination, and elsewhere after removal from the wall position (as at a desk or other location) and vice versa.

SUMMARY OF THE INVENTION

Basically, the invention is embodied in a picture display assembly that comprises:

(a) a rectangular, upright base frame having front and back sides, (b) means on the base by which it is connectible to a wall, (c) first horizontal ledge structure on the base frame and exposed at the front side thereof, the first ledge structure having at least one upwardly projecting, horizontally elongated tongue, (d) an upright picture display plate having front and back sides, and a transparent medial section adapted to register with said base frame, (e) means on the plate for supporting at least one translucent picture sheet to hang at the front side of said medial section of the plate, (f) and second horizontal ledge structure on and exposed at the rear side of the plate, the second ledge structure having at least one downwardly projecting, horizontally elongated tongue sized to removably and downwardly seat over the first ledge structure tongue for removably supporting the plate on the base frame and at the front side thereof.

As will appear, means on the plate releasably supports such sheets; so as to be illuminated by a light source in a hollow defined by the frame; the plate is liftable off the frame as by a handle on a flange defined by the plate which is typically larger than the frame to define multiple flanges; the plate may be locked to the frame; and the ledge may be located at upper and lower locations, and tapered, to urge the plate toward the frame, by gravity force exertions.

These and other objects and advantages of the invention, as well as the details of an illustrative embodiment, will be more fully understood from the following specification and drawings, in which:

DRAWING DESCRIPTION

DETAILED DESCRIPTION

Figure 1:
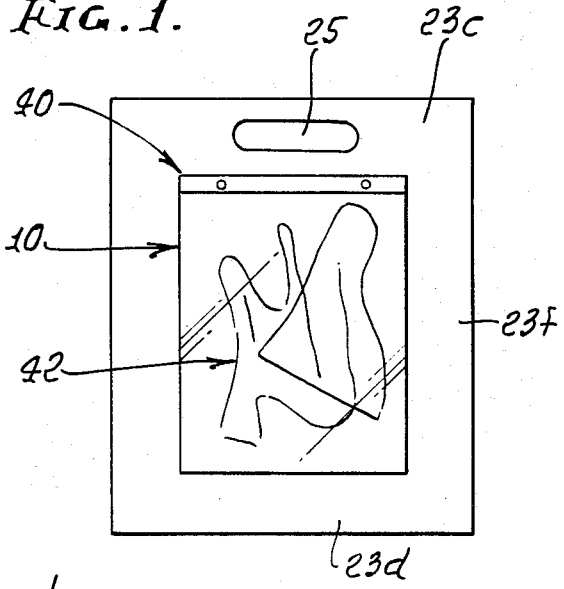
FIG. 1 is a front elevation of the plate on the frame.

In the drawings, a rectangular base frame 10 has vertical peripheral frame members 11 and 12, and horizontal peripheral frame members 13 and 14. The frame also has back side members 15 and 16. An opening 17 in the member 15 passes a fastener or pin 18, by which the frame is connectible to wall 19 in pivotably suspended condition. An opening 20 in member 16 passes a fastener or pin 21, by which the frame is also connectible to the wall, the opening 20 widened to permit pivoting of the frame to precisely vertical orientation before fastener 21 is tightened.

Figure 7:
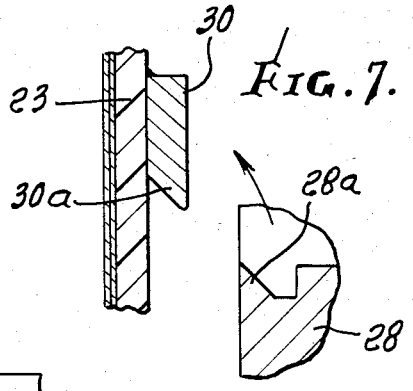
FIG. 7 is a fragmentary elevation showing plate and frame separations.

An upright picture display plate 23 is provided for ready connection to and disconnection from the base frame 10. Plate 23 has front and back sides **23*a* and 23*b*, and may desirably consist of transparent plastic such as lucite, or glass, for example. It typically is rectangular and of greater length and width than the length and width of the base frame, whereby the plate defines flanges 23*c* and 23*d*, 23*e*, and 23*f* projecting laterally away from the frame, as seen in FIG. 1. A handle means on the plate (as for example slot or through opening 25 in flange 23*e*) allows manual lifting of the plate, upwardly and away from the frame, to free the plate from the frame. See FIG. 7, and arrow 26** indicating such upward and frontward displacement of the plate relative to the frame.

Figure 3:
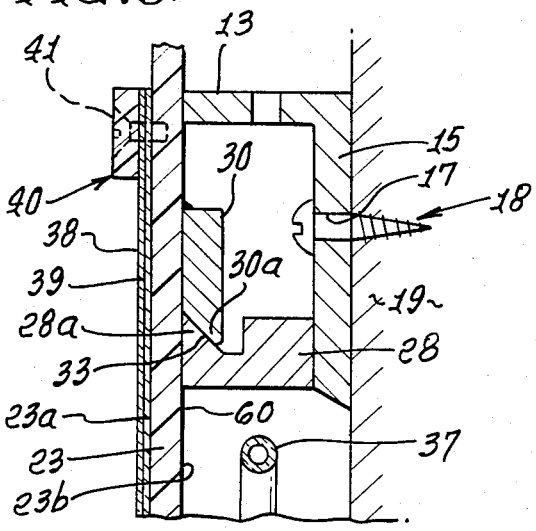
FIGS. 3–6 are enlarged fragmentary sections taken on lines 3—3, 4—4, 5—5 and 6—6 respectively, in FIG. 2.
Figure 5:
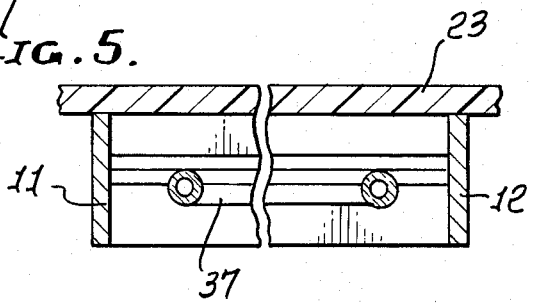
Figure 4:
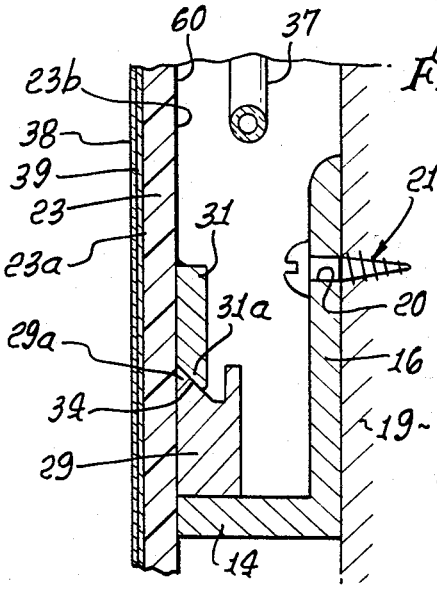

Also provided is first horizontal ledge structure on the base frame, as for example vertically spaced upper and lower ledges 28 and 29 which are upwardly projecting and horizontally elongated between members 11 and 12 (see FIGS. 3 and 4), and exposed frontwardly of the frame. Tongue sections **28*a* and 29*a* are on horizontal ledge members 28 and 29 integral with the frame. Further, second horizontal ledge structure is provided on the plate 23 at the rear side thereof, as for example upper and lower tongue sections 30*a* and 31*a* on horizontal ledge members 30 and 31, the tongue sections being downwardly projecting and horizontally elongated between members 11 and 12. As a result, the tongues 30*a* and 31*a* removably hook downwardly and over the tongues 28*a* and 29*a* as the plate in 23 is assembled to the frame, the plate held to the frame by gravity retention of the tongues in interfit relation. The tongue interfit surfaces may be tapered downwardly and rearwardly as shown at locations 33 and 34, to enhance the ease and readiness of assembly and disassembly. Ledge members 30 and 31 may consist of plastic or glass strips adhesively bonded to the back side of plate 23**. The frame may consist of wood, plastic, or other material.

A central hollow 36 defined by the frame contains a light source, such as neon lamp 37 to pass light through the medial or central section of the plate immediately forward of the frame, to illuminate a picture sheet or sheets 38 and 39 carried by the plate. Note that the neon bulb passes upwardly between ledge sections 28. Sheets 38 and 39 may be suspended by a strip 40 (see FIG. 3) removably connected as by fastener 41 to plate 23. Sheets 38 and 39 extend in overlay relation to form are illuminated composite picture 42, as viewed in FIG. 1. The picture may be readily detached as by lifting from the wall frame, using handle opening 25, to temporarily transport the picture plate and sheets wherever desired. The rear side **23*b* of the plate 23 may typically carry a thin light diffusing coating 60** of a material such as a suitable spray paint, to diffuse light passing forwardly through the translucent coat.

Figure 6:
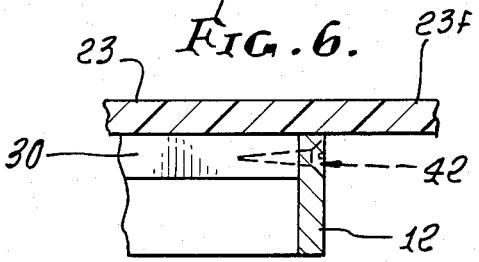

FIG. 6 shows a lock means, such as a fastener 42 accessible behind at least one flange (see flange **23*f*) to hold the plate locked to the frame, if desired. Fastener 42 extends from frame member 12 into the second ledge structure (ledge 30, for example) on the plate 23**.

Figure 2:
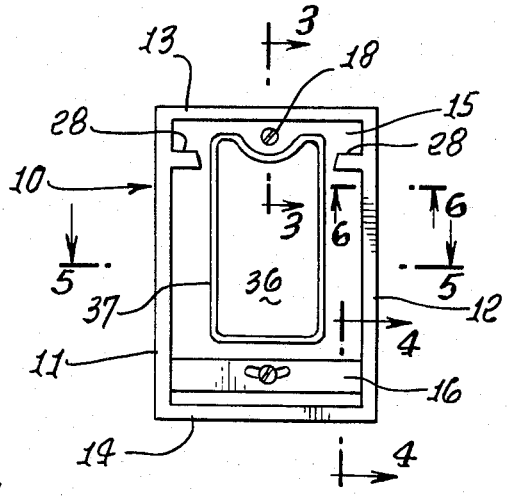
FIG. 2 is a front elevation of the frame.
Figure 8:
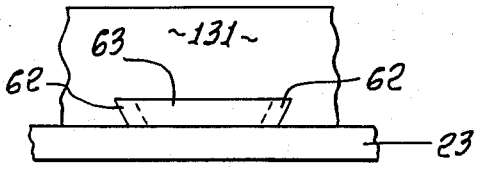
FIG. 8 is a top plan view of a modification.

FIG. 8 shows an alternate ledge structure as may be incorporated at upper and lower levels. It includes laterally spaced downwardly tapering dovetail ledge seats 62 at opposite sides of a groove cut in a transverse ledge member 131 (corresponding) to member 13 in FIG. 2. The plate 23 carries dovetail ledge or tongue 63 constructed to seat downwardly and interfit seats 62. The seats 62 and tongue 63 are downwardly wedge shaped.

I claim:

1. A picture display assembly, comprising (a) a rectangular, upright base frame having front and back sides, (b) means on the base from which it is connectible to a wall, (c) first horizontal ledge structure on the base frame and exposed at the front side thereof, the first ledge structure having at least one upwardly projecting, horizontally elongated tongue, (d) an upright picture display plate having front and back sides, and a transparent medial section adapted to register with said base frame, (e) means on the plate for supporting at least one translucent picture sheet to hang at the front side of said medial section of the plate, (f) and second horizontal ledge structure on and exposed at the rear side of the plate, the second ledge structure having at least one downwardly projecting, horizontally elongated tongue sized to removably and downwardly seat over the first ledge structure tongue for removably supporting the plate on the base frame and at the front side thereof.

2. The assembly of claim 1 wherein the display frame defines a hollow immediately rearward of the medial section of the plate, and a light source in said hollow to pass light through the said medial section of the transparent plate to illuminate said translucent picture sheet.

3. The assembly of claim 2 including at least two of said translucent picture sheets hanging at the front side of the display plate and in picture overlay relation to pass said light, and means on the plate releasably supporting such sheets.

4. The assembly of claim 3 wherein said plate is rectangular and of greater length and width than the length and width of said frame whereby the plate defines flanges projecting away from the frame, and handle means on the plate to allow manual lifting of the plate upwardly and away from the frame to free the plate from the frame.

5. The assembly of claim 1 wherein said first ledge structure includes vertically spaced upper and lower tongue sections, and said second ledge structure also includes vertically spaced upper and lower tongue sections, the upper tongue sections adapted to interfit, and the lower tongue sections adapted to interfit.

6. The assembly of claim 5 wherein the interfitting tongue sections are mutually tapered to urge the plate toward and against the frame as the plate weight urges the plate downwardly.

7. The assembly of claim 4 including lock means accessible behind at least one of said flanges to hold the plate attached to the frame.

8. The assembly of claim 7 wherein said lock means includes a fastener extending from the frame removably into said second ledge structure.

9. The combination of claim 1 wherein said (e) means comprises transversely opposed seats, and said (f) ledge structure is configured to fit between and engage said seats.

* * * * *